United States Patent [19]

Madigan

[11] 3,982,484

[45] Sept. 28, 1976

[54] ROLLER MOISTENING WICK SYSTEM FOR PREVENTING DRIPPING WITHIN A DUPLICATING MACHINE

[75] Inventor: Thomas M. Madigan, Pittsford, N.Y.

[73] Assignee: Itek Corporation, Lexington, Mass.

[22] Filed: Jan. 3, 1975

[21] Appl. No.: 538,487

[52] U.S. Cl. ..... 101/422; 101/232

[51] Int. Cl.[2] ..... B41F 7/38; B41F 23/02

[58] Field of Search ..... 101/147, 148, 422, 132.5, 101/416 R, 420, 421, 423; 118/260, 268

[56] References Cited

UNITED STATES PATENTS

| | | | |
|---|---|---|---|
| 1,958,593 | 5/1934 | Schultz | 101/147 |
| 2,106,732 | 2/1938 | Goedike | 101/147 |
| 2,345,335 | 3/1944 | Ford | 101/132.5 X |
| 2,465,160 | 3/1949 | Levenhagen et al. | 101/424 X |
| 2,510,256 | 6/1950 | Robinson et al. | 101/132.5 X |
| 2,700,933 | 2/1955 | White | 101/422 |

FOREIGN PATENTS OR APPLICATIONS

| | | | |
|---|---|---|---|
| 602,397 | 2/1960 | Italy | 101/147 |

*Primary Examiner*—Edgar S. Burr
*Assistant Examiner*—R. E. Suter
*Attorney, Agent, or Firm*—Homer O. Blair; Robert L. Nathans; Gerald H. Glanzman

[57] ABSTRACT

A roller wick is positioned to transmit moisture in an uphill direction by capillary action from a roller wick reservoir to an inked paper roller drive means. A thicker relay wick transmits relatively large amounts of fluid from a relay wick reservoir, positioned higher than the roller wick reservoir, to the roller wick reservoir. The relay wick itself is positioned over the roller wick reservoir so that any drippings therefrom are deposited within the roller wick reservoir.

2 Claims, 1 Drawing Figure

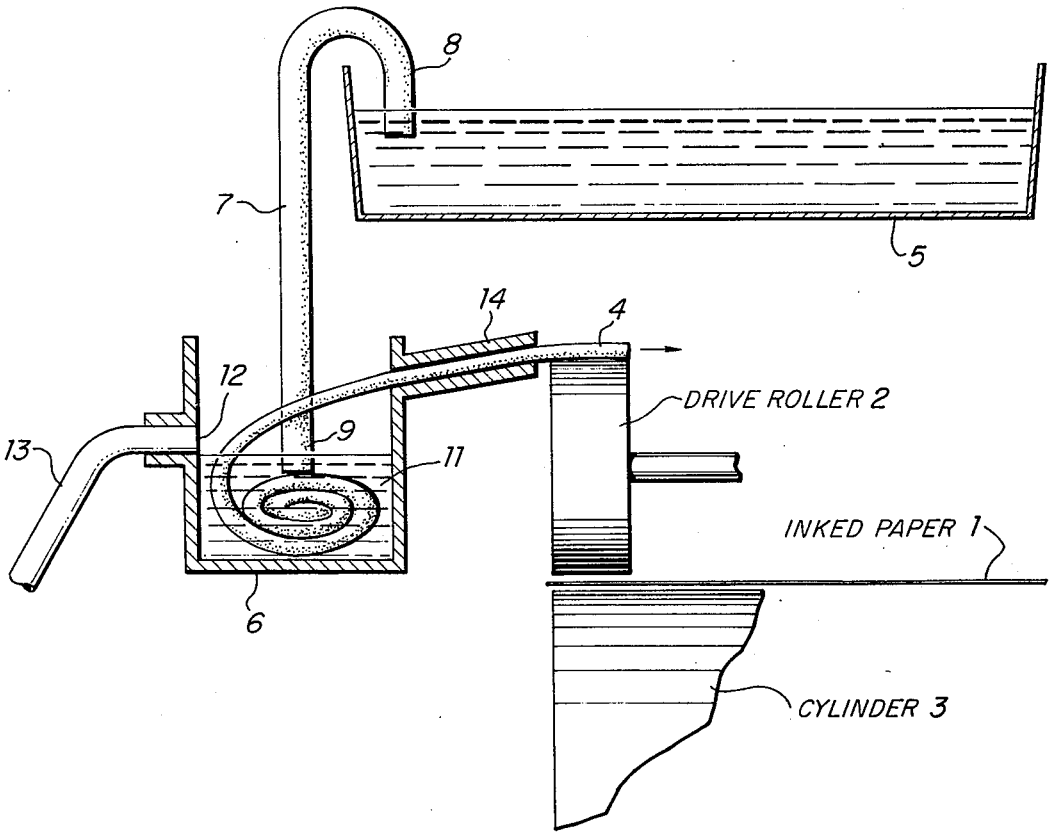
8
7
5
14
4
12
DRIVE ROLLER 2
9
13
11
INKED PAPER 1
6
CYLINDER 3

ROLLER MOISTENING WICK SYSTEM FOR PREVENTING DRIPPING WITHIN A DUPLICATING MACHINE

BACKGROUND OF THE INVENTION

It is known in the art to provide a fluid reservoir in an upper portion of a duplicating machine which transmits moisture to an inked paper drive roller via an intermediate wick coupled between the reservoir and the roller. This moisture helps prevent ink accumulation on the roller which buildup can produce black streaking on the paper driven by the roller. This problem is most troublesome when the drive roller contacts paper having bleed edge inked printing thereon so that the roller is more or less continuously in contact with inked areas. An annoying problem associated with prior art wick systems such as that disclosed in U.S. Pat. No. 2,700,933 to T. C. White, is that water drips from the wick into the machine. Another problem is that such wicks may dry out over long periods such as extended weekends.

SUMMARY OF THE INVENTION

In accordance with a preferred embodiment, the abovementioned problems are eliminated by providing a relatively thick relay wick, positioned within a relay wick reservoir having a large fluid capacity, which wick is susceptible to dripping, and positioning it over a roller wick reservoir having an overflow orifice associated therewith. A roller wick is positioned within the roller wick reservoir and is oriented in an uphill direction so that fluid is transmitted to the roller by capillary action, thereby to thwart further dripping.

Other objects, features and advantages of the present invention will become apparent from perusal of the following description taken in conjunction with the sole figure which illustrates a preferred embodiment.

DETAILED DESCRIPTION

In the FIGURE, a portion of inked paper 1 (inked side up) is shown between the nip of drive roller 2 and cylinder 3. In order to prevent ink buildup upon the periphery of drive roller 2, roller wick 4 contacts the periphery of roller 2. The other end of wick 4 is coiled up and positioned within roller wick reservoir 6 as illustrated. A larger relay wick reservoir, considerably larger than the roller wick reservoir 6, 5 is positioned above the aforementioned structure and relay wick 7 has one end 8 positioned within reservoir 5 and the other end 9 positioned beneath surface 11 of the fluid within roller wick reservoir 6. Relay wick 7 is preferably one-quarter of an inch in diameter in contrast to roller wick 4 which is one-eighth of an inch in diameter, and as a result relatively abundant quantities of fluid are continuously supplied to roller wick reservoir 6. As a result of this condition, overflow orifice 12 and tube 13 prevent relay wick reservoir 6 from containing too much fluid. The continual presence of abundant fluid in reservoir 6 prevents the above-mentioned problem of wick dry out over long weekends, etc. Furthermore, since relay wick 7 is positioned over the roller wick reservoir 6, drippings do not get into the machine. Sleeve 14 is oriented in a slightly uphill direction so that fluid is transmitted from roller wick reservoir 6 to roller 2 by capillary action rather than by the virtue of gravity. The combination of this uphill wick orientation together with the wick support sleeve member 14 eliminates the dripping problem. After a time, it is desirable to cut off the terminal portion of wick 4 and expose a fresh portion. This is readily carried out by pulling wick 4 out and cutting off the used terminal portion. In the system constructed by the inventor, the wicks were made of felt. Since relay wick reservoir 5 is preferably relatively large, the operator need not be concerned with replenishing the fluid except at great intervals. In summary, the prior art problems of dripping and drying out of the wick have been eliminated by this invention.

The term "relay wick reservoir" is intended to cover virtually any fluid source such as, for example, a pipe having a wicked drip drain. Also I have successfully used a straight wick mounted in a hole in the bottom of the relay wick reservoir. Since this configuration drips more water than the "candy cane" wick illustrated, the wick diameter was reduced to be the same size as the roller wick.

While preferred embodiments of the invention have been described, the teachings of this invention will readily suggest many other embodiments to those skilled in the art.

What is claimed is:

1. In a duplicating machine, an improved wick system for preventing ink build-up on a paper drive roller which transports said paper within said duplicating machine, said system comprising:

a. a roller wick reservoir for containing fluid therein;

b. a roller wick having one end thereof positioned within said roller wick reservoir and having an opposite end contacting said drive roller;

c. a sleeve member positioned between said roller wick reservoir and said drive roller for surrounding and supporting said roller wick to orient said roller wick in an upward direction with respect to said roller wick reservoir, and for preventing dripping of water within said roller wick into lower portions of said duplicating machine;

d. a relay wick reservoir having a substantially greater fluid capacity than said roller wick reservoir for containing large quantities of fluid to be supplied to said roller wick reservoir over greatly extended time periods;

e. a relay wick having a first terminal portion within said relay wick reservoir and a second terminal portion within said roller wick reservoir, said relay wick being substantially fatter than said roller wick and being positioned directly over said roller wick reservoir, thereby to continuously supply relatively abundant quantities of fluid to said roller wick reservoir; and f. overflow means formed within said roller wick reservoir for draining any excess quantities of fluid supplied to said roller wick reservoir by said relay wick.

2. The combination as set forth in claim 1 wherein said relay wick is cylindrical and approximately one-fourth inch in diameter and said roller wick is cylindrical and approximately one-eighth inch in diameter.

* * * * *